US011668142B2

(12) United States Patent
Berry et al.

(10) Patent No.: US 11,668,142 B2
(45) Date of Patent: Jun. 6, 2023

(54) HORIZONTAL OFF-RIG CASING AND DRILL PIPE ASSEMBLY

(71) Applicant: SCHLUMBERGER TECHNOLOGY CORPORATION, Sugar Land, TX (US)

(72) Inventors: Joe Rodney Berry, Cypress, TX (US); Aaron Bryant, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 80 days.

(21) Appl. No.: 17/429,390

(22) PCT Filed: Feb. 11, 2020

(86) PCT No.: PCT/US2020/017658
§ 371 (c)(1),
(2) Date: Aug. 9, 2021

(87) PCT Pub. No.: WO2020/167764
PCT Pub. Date: Aug. 20, 2020

(65) Prior Publication Data

US 2022/0145709 A1 May 12, 2022

Related U.S. Application Data

(60) Provisional application No. 62/803,771, filed on Feb. 11, 2019.

(51) Int. Cl.
*E21B 19/20* (2006.01)
*E21B 19/15* (2006.01)

(52) U.S. Cl.
CPC ..... *E21B 19/15* (2013.01); *E21B 19/20* (2013.01)

(58) Field of Classification Search
CPC ..... E21B 19/15; E21B 19/20
See application file for complete search history.

(56) References Cited

U.S. PATENT DOCUMENTS 4,081,087 A * 3/1978 Freeman, Sr. ..... E21B 19/155 414/22.52
4,486,137 A * 12/1984 Buckner ..... E21B 19/15 280/43.23

(Continued)

FOREIGN PATENT DOCUMENTS

WO 2011017471 A2 2/2011

OTHER PUBLICATIONS

International Preliminary Report on Patentability of International Patent Application No. PCT/US2020/017658 dated Aug. 26, 2021; 9 pages.

(Continued)

*Primary Examiner* — Taras P Bemko
(74) *Attorney, Agent, or Firm* — Jeffrey D. Frantz

(57) ABSTRACT

A stand-building system and method for a drilling rig, of which the system includes a casing preparation skid configured to prepare a casing joint for connection to another casing joint, and a casing stand assembly skid configured to receive the prepared casing joint and to connect together the prepared casing joint with one or more other joints so as to form a casing stand. The casing preparing skid and the casing stand assembly skid are horizontally aligned with and extend parallel to one another and to a catwalk of the drilling rig, and the casing stand assembly skid is configured to deliver the casing stand to the catwalk.

20 Claims, 8 Drawing Sheets

(56) References Cited

U.S. PATENT DOCUMENTS

| | | | | |
|---|---|---|---|---|
| 10,794,126 | B2 * | 10/2020 | Magnuson | E21B 19/16 |
| 2003/0159854 | A1 | 8/2003 | Simpson et al. | |
| 2009/0053013 | A1 * | 2/2009 | Maltby | E21B 19/15<br>414/22.61 |
| 2010/0163247 | A1 | 7/2010 | Wright et al. | |
| 2011/0030942 | A1 * | 2/2011 | Orgeron | F16L 1/19<br>166/77.51 |
| 2017/0096867 | A1 | 4/2017 | Folk | |
| 2017/0260818 | A1 * | 9/2017 | Berry | E21B 19/14 |
| 2019/0017334 | A1 | 1/2019 | Loeyning et al. | |
| 2019/0106950 | A1 * | 4/2019 | Alvaer | E21B 19/16 |
| 2019/0128077 | A1 * | 5/2019 | Holand | E21B 41/00 |

OTHER PUBLICATIONS

Search Report and Written Opinion of International Patent Application No. PCT/US2020/017658 dated Jun. 9, 2020; 12 pages.

* cited by examiner

HORIZONTAL OFF-RIG CASING AND DRILL PIPE ASSEMBLY

CROSS-REFERENCE TO RELATED APPLICATIONS

This application claims priority to U.S. Provisional Patent Application having Ser. No. 62/803,771, which was filed on Feb. 11, 2019 and is incorporated herein by reference in its entirety.

BACKGROUND

Drilling rigs are employed to bore into the earth in an effort to produce hydrocarbons therefrom, and in order to do so, the rigs make use of oilfield tubulars. One type of oilfield tubular is a drill pipe. A drill pipe may be attached to a top drive, or another drilling structure on the rig, at a top end, and a bottom-hole assembly (including a drill bit, among other things) on the bottom. At its simplest form of operation, the drill pipe is rotated, which in turn rotates the drill bit, which advances into the ground. Additional drill pipes are progressively added to form a string, allowing continued advancement of the drill bit.

Casing is another type of oilfield tubular. Once a section of a wellbore is drilled, casing is run into, and, e.g., cemented in place, to secure the wellbore. Casing is typically deployed or "tripped-in" using a variety of different casing running tools. There are other ways this sequence can occur (e.g., drilling-while-casing).

Connecting together segments of drill pipe and/or casing takes a considerable time. To mitigate this, two or more lengths of drill pipe or two or more lengths of casing are often connected together into stands in advance of being run into the wellbore. The stands are then added to the drill string or casing string (depending on the operation), rather than the individual joints.

In some situations, the area surrounding the drilling rig is freely available, and thus stand-building operations can be conducted before drilling operations, such that as many stands as are expected to be used can be constructed. However, other situations call for more efficient use of the land at the wellsite. This can present a challenge, as stand-building often takes longer than running or drilling the same length of tubulars, i.e., operators can be left waiting for stands to be built, which is non-productive time that is generally to be avoided.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A stand-building system for a drilling rig is disclosed. The system includes a casing preparation skid configured to prepare a casing joint for connection to another casing joint, and a casing stand assembly skid configured to receive the prepared casing joint and to connect together the prepared casing joint with one or more other joints so as to form a casing stand. The casing preparing skid and the casing stand assembly skid are horizontally aligned with and extend parallel to one another and to a catwalk of the drilling rig, and the casing stand assembly skid is configured to deliver the casing stand to the catwalk.

A method of stand-building and just-in-time delivery thereof to a drilling rig is also disclosed. The method includes receiving a casing joint into a casing preparation skid, preparing the casing joint for assembly into a casing stand using the casing preparation skid, receiving the prepared casing joint into a casing stand assembly skid, connecting the prepared casing joint with at least one other casing joint so as to form a casing stand, using the casing stand assembly skid, and receiving the casing stand into a catwalk that is configured to deliver the casing stand to tubular handling equipment of a drilling rig. The casing preparation skid and the casing stand assembly skid are horizontally aligned with and extend parallel to one another and the catwalk.

A method of stand-building and just-in-time delivery thereof to a drilling rig is further disclosed. The method includes receiving a casing joint into a first casing buffer rack, receiving the casing joint from the first casing buffer rack into a casing preparation skid, preparing the casing joint for assembly into a casing stand using the casing preparation skid, depositing the prepared casing joint into a second casing buffer rack, receiving the prepared casing joint from the second casing buffer rack into a casing stand assembly skid, connecting the prepared casing joint with at least one other casing joint so as to form a casing stand, using the casing stand assembly skid, depositing the casing stand into a casing stand buffer rack, and receiving the casing stand from the casing stand buffer rack into a catwalk of the drilling rig that is configured to deliver the casing stand to tubular handling equipment of the drilling rig. The casing preparation skid and the casing stand assembly skid are horizontally aligned with and extend parallel to one another and the catwalk. Further, receiving the casing joint from the first casing buffer rack into the casing preparation skid is only performed in response to at least one of the second casing buffer rack having a predetermined low number of casing joints contained therein; or a run rate of casing into a well. In addition, receiving the at least one casing joint from the second casing buffer rack into the casing stand assembly skid is only performed in response to at least one of the casing stand buffer rack having a predetermined low number of casing stands contained therein, the run rate of casing into the well.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
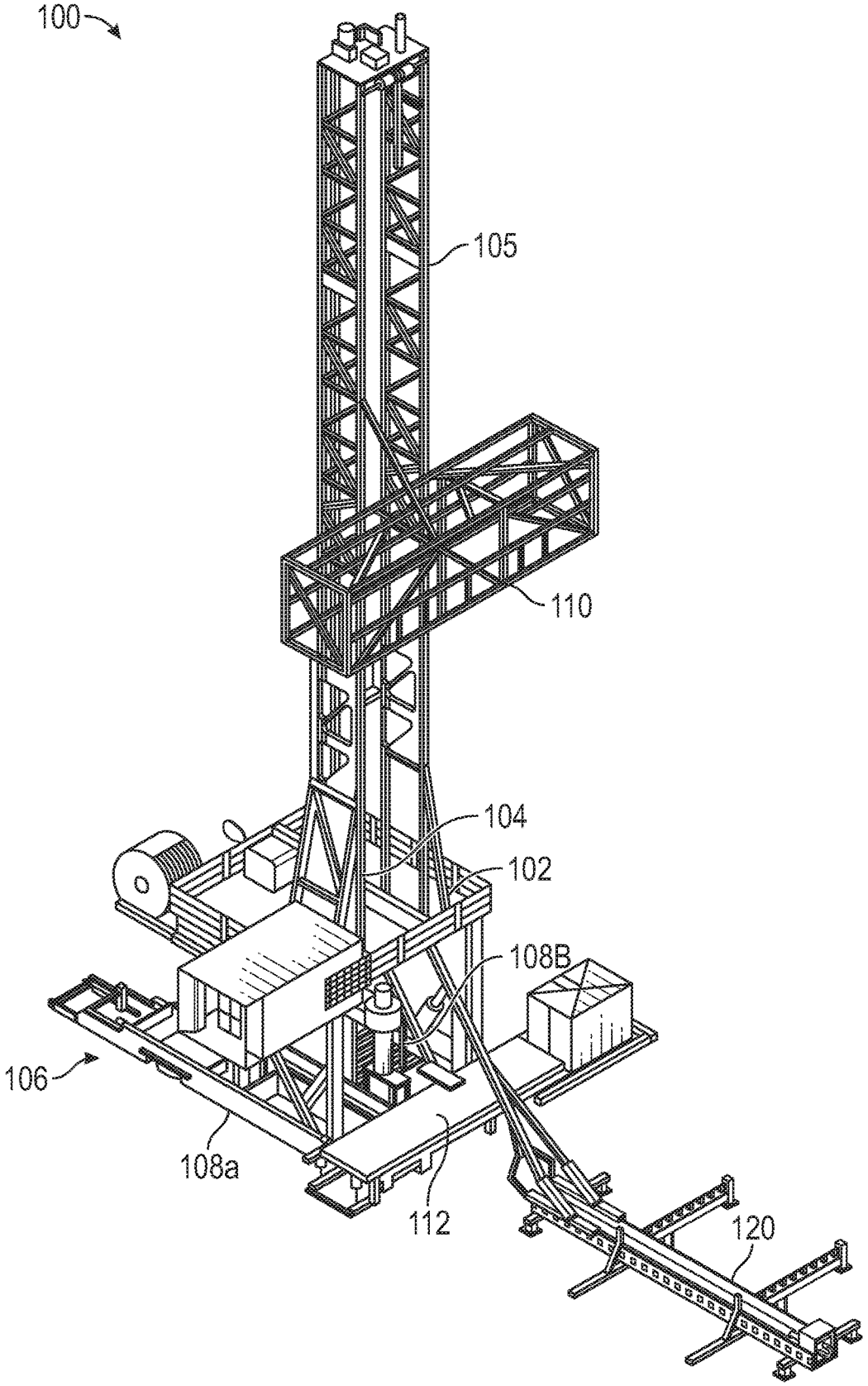
FIG. 1 illustrates an isometric view of a drilling rig, according to an embodiment.

FIG. 1 illustrates an isometric view of a drilling rig 100, according to an embodiment. The drilling rig 100 includes a drill (or "rig") floor 102 that is positioned above a well center 104. The drilling rig 100 further includes a mast 105 that extends upwards from the drill floor 102, generally in alignment with well center 104. Drilling equipment (e.g., a top drive), tubular handing equipment, etc., may move up and down along the mast 105.

Further, the drill floor 102 may be elevated with respect to the ground by a substructure 106, which generally includes two base boxes 108A, 108B, disposed in parallel on either side of the well center 104, as shown. The drilling rig 100 also includes a rack 110, which may support an upper end of tubulars (e.g., casing, drill pipe, etc.) that are prepared and stored in vertical orientation for running into/out of the well. A setback 112, below the rack 110, is provided for supporting the lower end of the tubulars in the rack 110. In this embodiment, the setback 112 is located below the drill floor 102, e.g., near or on the ground. In another embodiment, the setback 112 may be located at the drill floor.

The drilling rig 100 also includes a catwalk 120, which is provided for moving tubulars generally from the ground, in a horizontal orientation, upwards toward the drill floor 102. At the drill floor 102, tubular handling equipment (e.g., elevators) may be employed to grip and hoist the upper end of the tubular from the top of the catwalk 120 and provide the upper end of the tubular, generally in a vertical orientation, into the rack 110 and the setback 112. In some embodiments, additional tubular handling equipment may be provided in the rack 110 (e.g., cranes) to move the tubulars into position in the rack 110.

The tubulars in the rack 110 generally are stands of two or more (e.g., three) segments or "joints" of pipe that are connected or "made up" together. Accordingly, the drilling rig 100 may include a horizontal pipe preparation assembly.

Figure 2:
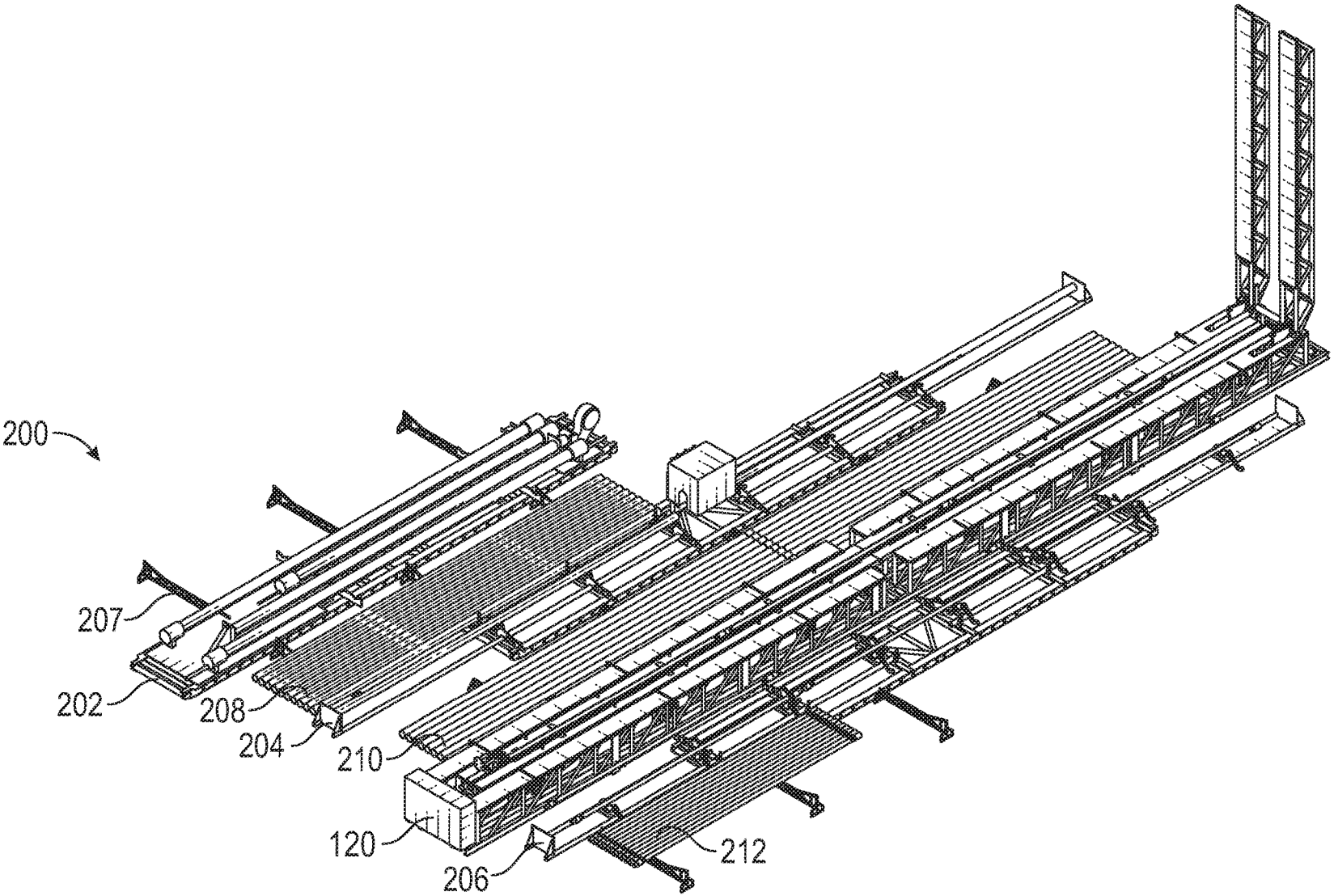
FIG. 2 illustrates an isometric view of a horizontal stand building assembly, along with a catwalk of the drilling rig, according to an embodiment.
Figure 3:
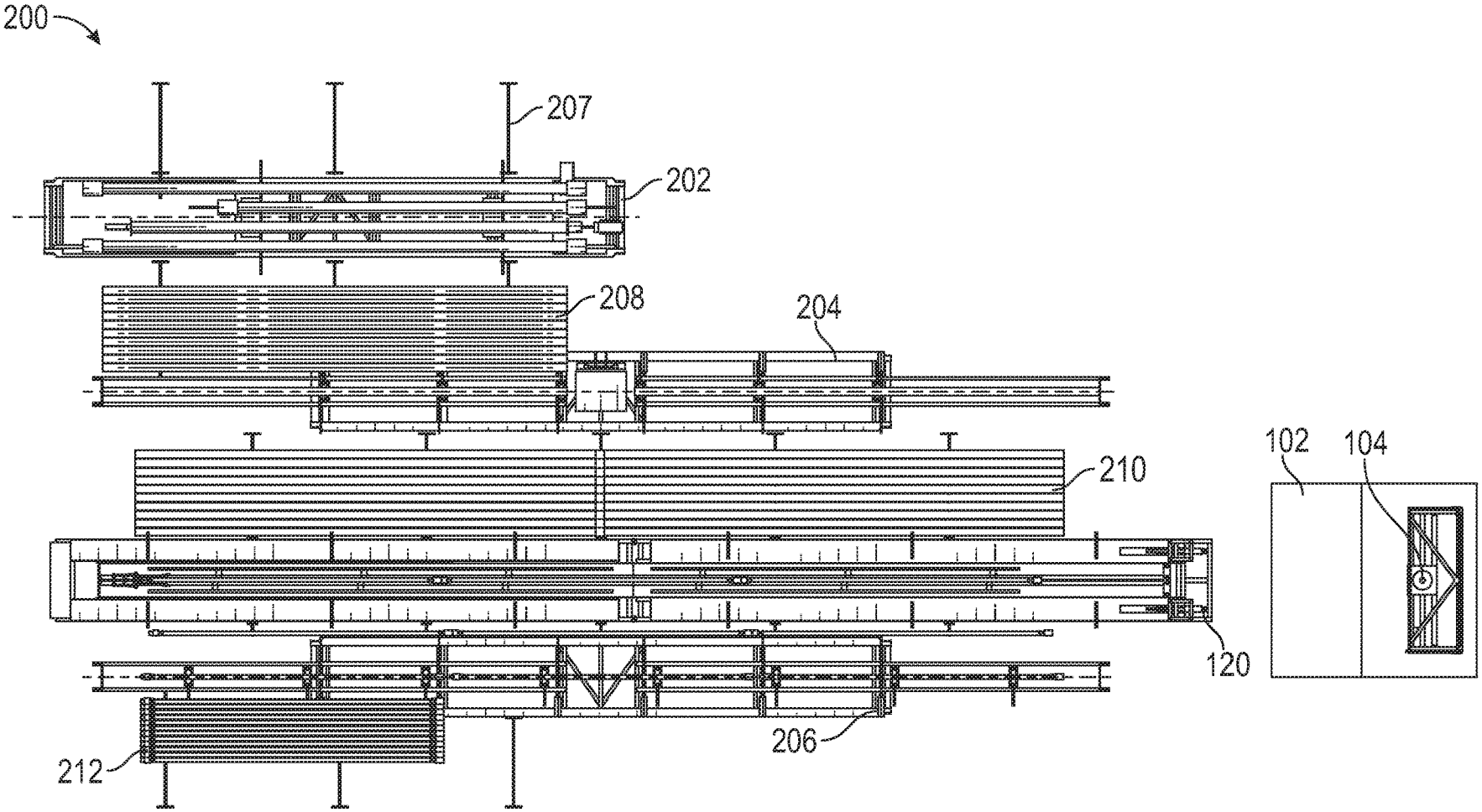
FIG. 3 illustrates a top plan view of the horizontal stand building assembly and catwalk, according to an embodiment.

An example of such a preparation assembly is shown in FIGS. 2 and 3, according to an embodiment. In particular, FIG. 2 illustrates an isometric view of such a horizontal pipe preparation assembly 200, along with the catwalk 120, according to an embodiment. FIG. 3 illustrates a top, plan view of the assembly 200 and the catwalk 120, according to an embodiment. As shown in FIGS. 2 and 3, the assembly 200 generally includes a casing preparation skid 202, a casing stand assembly skid 204, and a drill pipe stand skid 206. The casing preparation skid 202 and the casing stand assembly skid 204 may be generally horizontally-aligned and oriented parallel to one another, and parallel to and one on side of the catwalk 120. In this context, "horizontally-aligned" refers to objects that are generally horizontally next to one another. One specific example of this is where the longitudinal ends of two elongate objects are adjacent to one another. Further, the skids 202, 204 and the catwalk 120 may be "vertically aligned," which refers to objects positioned at the same elevation, e.g., on the ground, as shown for the skids 202, 204 in FIG. 2. For example, the casing stand assembly skid 204 may be between the casing preparation skid 202 and the catwalk 120. The pipe stand skid 206 may also be oriented in parallel to the catwalk 120, and may be positioned on the opposite side thereof from the casing preparation skid 202 and the casing stand assembly skid 204.

A casing buffer rack 207 may be positioned on one side of the casing preparation skid 202. Positioned between the casing preparation skid 202 and the casing stand assembly skid 204 is a second casing buffer rack 208. Similarly, between the casing stand assembly skid 204 and the catwalk 120, there is positioned a casing stand buffer rack 210. Additionally, a drill pipe buffer rack 212 is positioned next to or coupled to the drill pipe stand skid 206, e.g., such that the skid 206 is between the rack 212 and the catwalk 120. The buffer racks 207, 208, 212 may be positioned such that gravity is used to transport the casing between the racks 207, 208, 212 and associated skids 202, 204, 206. In another embodiment, the buffer racks 207, 208, 210, 212 may be chain-driven and capable of moving the respective casing/drill pipe transversely, between the skids 202, 204, 206 and the catwalk 120. In some embodiments, one or more of the buffer racks 207, 208, 212 may be omitted, and the tubulars may be transferred directly between the skids 202, 204, 206 and/or the catwalk 120.

Figure 4:
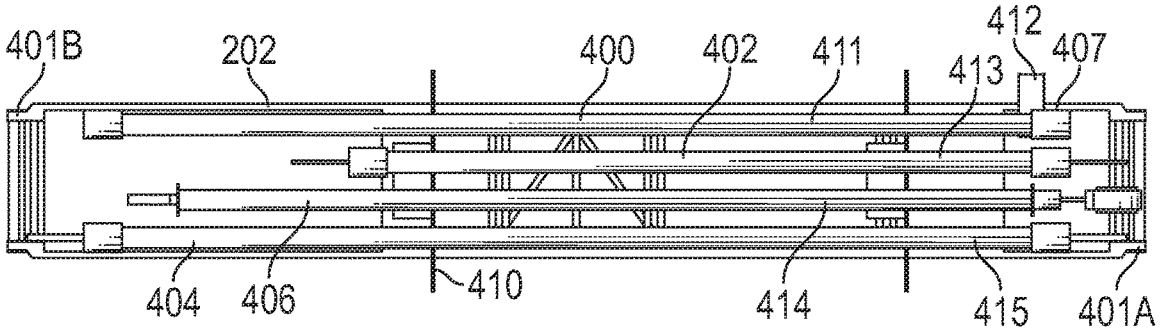
FIG. 4 illustrates a top plan view of a casing preparation skid, according to an embodiment.
Figure 5:
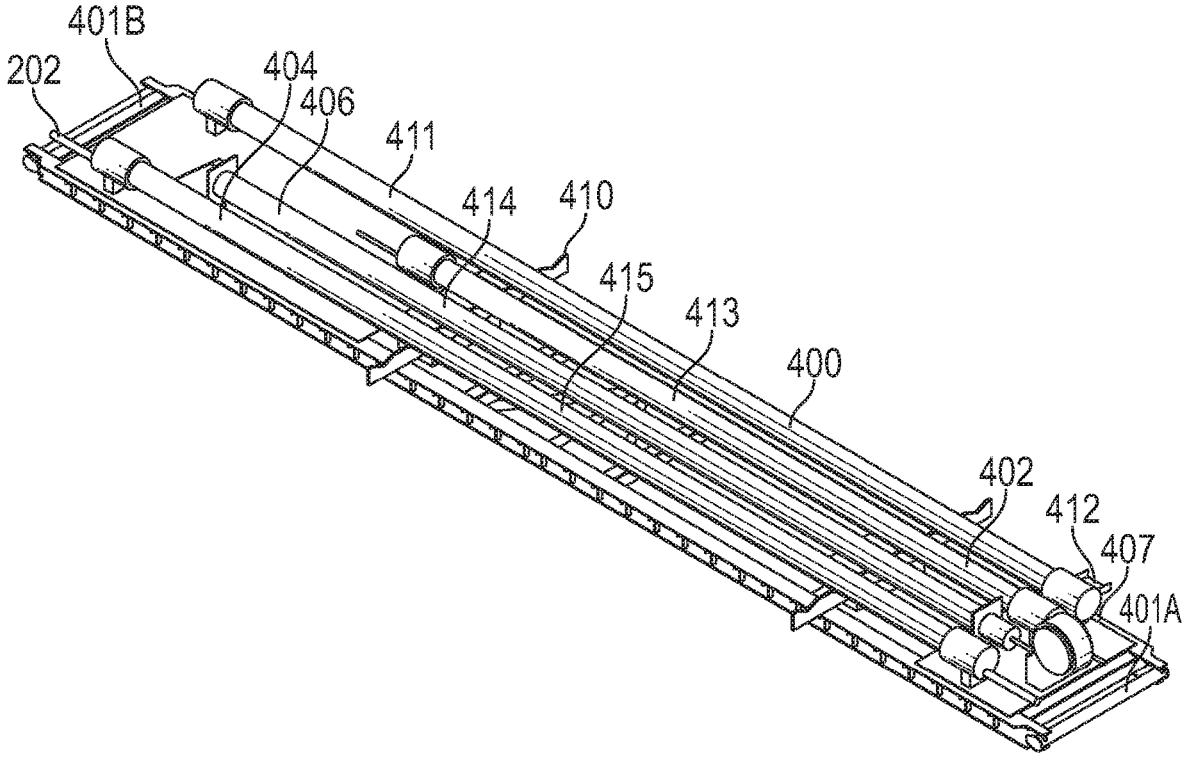
FIG. 5 illustrates an isometric view of the casing preparation skid, according to an embodiment.

FIG. 4 illustrates a side view, and FIG. 5 illustrates an isometric view, of the casing preparation skid 202, according to an embodiment. As shown, the skid 202 may generally have four stations: a thread protector removal station 400, a thread cleaning station 402, a drift and strap station 404, and a thread doping and marking station 406. Further, one end 401A of the skid 202 may be fixed, with the other end 401B is telescoping. This may allow for a variety of differently-sized pipes to be accommodated by the skid 202, and/or minimizing the transport size of the preparation skid 202. Further, the skid 202 may include a conveyor 410, which may extend transversely to the casing preparation skid 202, and may move casing joints 411 from the casing buffer rack 207, into the casing preparation skid 202 and into, between, and out of the respective stations 402, 404, 406, 408.

The casing joints 403 that are made-up together may have polymer or other relatively soft, protective coverings, referred to as "thread protectors," that cover the pin-end threads thereof, e.g., to protect the sensitive threads from damage during transport. The thread protectors are removed to expose the threads, prior to connecting the casing joints together. Accordingly, the operation of the casing preparation skid 202 may begin by loading one of the casing joints 411 into the thread protector removal station 400. For example, the casing preparation skid 202 may include a conveyor 410, which may be employed to move the casing joint 411 into position. The conveyor 410 may be externally driven, or may operate under force of gravity to move the casing joint 411 into position. A thread protector on the end of the casing joint 411 may then be removed and dropped through a thread protector chute 412. Although there appears to be a collar on both ends of the joint 411, it will be appreciated that joints 411 may have a collar on one end and a thread protector on the other.

For example, the thread protector removal process may occur as follows. A single casing joint is moved to the first station to remove the thread protectors. A casing clamp may be engaged to allow the protectors to be removed. Thread protector fixtures engage with both ends of the single casing joint simultaneously, spin the thread protectors out and then disengage the casing joint.

Another casing joint 413 may be in the thread cleaning station 402, having already passed through the thread protector removal station 400. In the thread cleaning station 402, thread cleaning fixtures may engage with the ends of the casing joint 413, e.g., simultaneously, and clean both the pin end and the coupling end of the casing joint 413, e.g., simultaneously, and disengage with the casing joint 413.

Still another casing joint 414 may be positioned in the drift-and-strap station 404. In this station, the casing joint 414, having its thread protector removed, and having been cleaned, is ready to be measured (or "strapped"), so as to determine its precise longitudinal dimension (length) with a greater degree of precision than is provided by the general specification and tolerance. Further, the casing joint 414 may be drifted in the drift-and-strap station 404, meaning a cylinder of a known diameter may be pulled through the casing joint 414, thereby ensuring a minimum inside diameter.

For example, the casing joint 414 may be moved from the thread cleaning station 402 and rolls to drift and strap station 404. Simultaneous to strapping, a drifting fixture is engaged with the casing joint, drifts the length of the casing, and then is disengaged from the casing joint. Sensors engage to strap the casing joint, the length of the casing is logged, and the casing is automatically marked with an identifying mark.

Another casing joint 415 may be positioned in the thread doping and marking station 406. Thread doping is a process by which pipe dope, generally a blend of lubricating grease and fine metallic particles that prevents thread galling and seals the threads, is brushed onto the threads of the casing joint 415. The single casing joint is moved from the strapping and drifting station position and rolls to the forth station position to dope the casing joint. Thread doping fixtures engage with both ends of the single casing joint simultaneously, cleans both the pin end and the coupling end of the casing joint simultaneously, dopes the pin and coupling ends and disengage with the casing joint. Further, the casing joint 415 may be marked in this station 406 (or in the station 404), with information identifying the casing joint 415 length.

The stations 402, 404, 406, 408 may operate in parallel with one another, e.g., on four separate casing joints 411-415, or fewer casing joint may be acted upon simultaneously, and thus one or more stations 402, 404, 406, 408 may be empty at any given point. In addition, although casing joints 411-415 are various different lengths are shown, it will be appreciated that, in some embodiments, the casing joints 411-415 may be roughly the same length (e.g., same specification, within a rough tolerance of, e.g., +/−5%).

Once a casing joint has traversed the four stations 402, 404, 406, 408, the conveyor 410 may move the casing joint onto casing lift arms, which may move the and into the casing buffer rack 208 (e.g., FIG. 2). Any number of casing joints may be positioned in the casing buffer rack 208, which may provide a repository for casing joints that are prepared for connection together in order to form stands of two, three, or more joints. When ready, casing lift arms of the casing stand assembly skid 204 may take casing joints from the buffer rack 208 and assemble the casing joints into stands.

Figure 6:
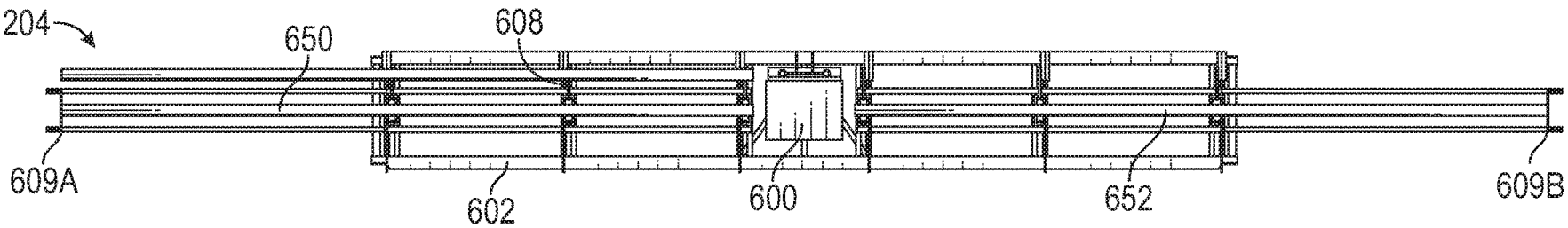
FIG. 6 illustrates a top plan view of a casing stand assembly skid, according to an embodiment.
Figure 7:
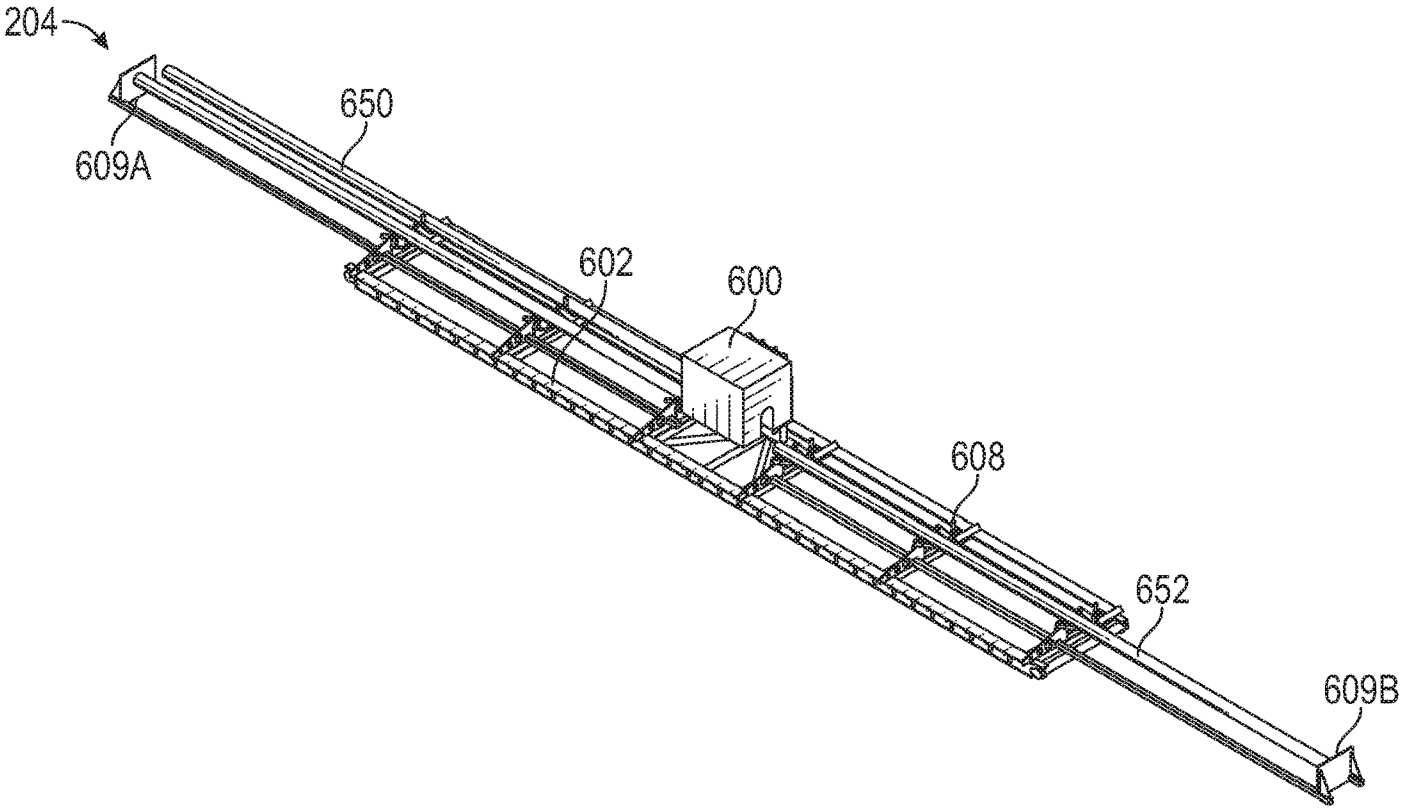
FIG. 7 illustrates an isometric view of the casing stand assembly skid, according to an embodiment.

FIGS. 6 and 7 illustrates a top plan view and an isometric view of the casing stand assembly skid 204, according to an embodiment. The casing stand assembly skid 204 may include lifting arms (e.g., four arms) that are configured to lift and lower casing onto/off of the aforementioned casing buffer racks 207, 208.

Further, the casing stand assembly skid 204 may include a bucking unit 600 positioned generally proximal to a center of a frame 602 of the skid 204. The bucking unit 600 may include components (e.g., a tong and a back-up wrench) configured to rotate casing joints relative to one another, thereby connecting threaded connections thereof together.

The casing stand assembly skid 204 may also include rollers 604, which may be configured to move casing joints longitudinally, toward or away from the bucking unit 600. Moreover, the bucking unit 600 may be positioned at an elevated position relative to the frame 602, and thus the casing stand assembly skid 204 may further include lifters 608 configured to raise and lower the casing joints on either side of the bucking unit 600. The casing stand assembly skid 204 may also include skid extensions 609A, 609B, which may slide toward or away from one another, to accommodate a variety of sizes of casing joints and stands.

In some embodiments, the casing stand assembly skid 204 may include a leveling and walking system. This may include hydraulic cylinders mounted at the corners of the skid 204, which may function to move the skid 204 up or down, e.g., to compensate for uneven grading, and/or to move or "walk" in a horizontal plane, e.g., to support rig walking and batch drilling operations.

In operation, a casing joint 650 is lifted by casing lift arms from the casing racks level to the casing stand building unit level (e.g., elevated upwards). The casing joint 650 is moved to the stand building v-rollers. The casing joint 650 is moved axially to position the pin end of the casing joint at an end stop of one of the skid extensions 609A. The casing tong and back up wrench of the bucking unit 600 are lowered to make-up position. The casing joint 650 is engaged by the casing back up tong mechanism.

A second casing joint 652 is lifted by the casing lift arms from the casing racks level to the casing stand building unit level. The second casing joint rolls into the rollers 604 at the bucking unit 600, and is moved axially to position the pin end of the casing joint 652 to engage with the bucking unit 600. The second casing joint 652 is leveled to the first casing joint and is moved axially to thread into the coupling end of the first casing joint 650, engaged with the casing wrench and torqued to the first casing joint 650. Upon verification of connection torque turns for the casing stand, the casing tong and back up disengage with the stand of casing and raises above the made-up stand from the casing stand building rollers 604.

In some embodiments, a third casing joint may be connected to the joints 650, 652. Accordingly, the already-connected joints 650, 652 may be withdrawn from the bucking unit 600 and moved to one side or the other, and the third casing joint may be likewise attached to the joints 650, 652 in order to add the additional joint to the stand. In other embodiments, the stand of casing may be made from only two joints (e.g., the joints 650, 652, as shown).

Once a stand is made, the stand may be moved into the casing stand buffer rack 210 (e.g., FIG. 2). From this buffer rack 210, the casing stand may be loaded into the catwalk 120 and moved to a vertical position on the rig 100, as previously described.

Figure 8:
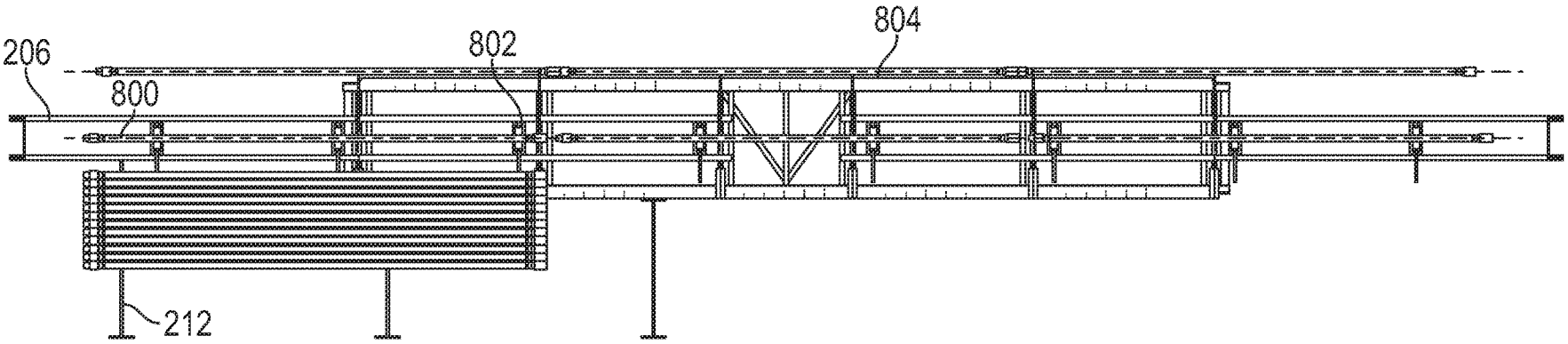
FIG. 8 illustrates a top plan view of a drill pipe assembly skid, according to an embodiment.
Figure 9:
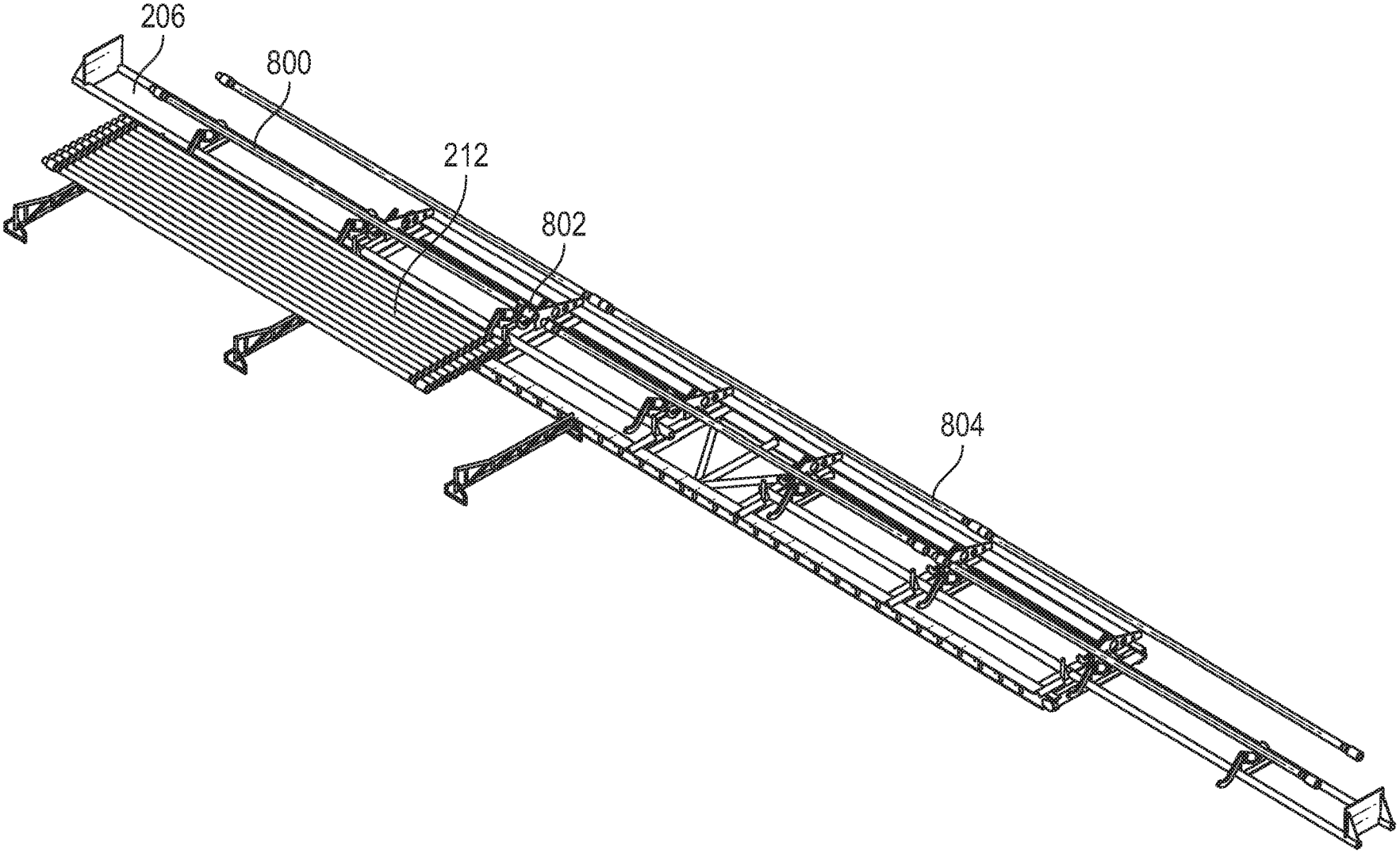
FIG. 9 illustrates an isometric view of the drill pipe assembly skid, according to an embodiment.

FIGS. 8 and 9 illustrate a top, plan view and an isometric view of the drill pipe stand skid 206, according to an embodiment. As shown, the drill pipe stand skid 206 may receive drill pipes 800 from the drill pipe buffer rack 212. Further, the drill pipe stand skid 204 may include rollers 802 that are configured to move the drill pipe 800 along the skid 204. The rollers 802 may further be configured to connect the drill pipes 800 together, end-to-end, e.g., forming stands of three drill pipes. The stands may then be moved onto a drill pipe stand buffer rack 804, and from there, into the catwalk 120 (e.g., FIG. 1) and moved onto the rig 100 (FIG. 1), as previously discussed. The drill pipe stand skid 206 may include a plurality of stations, which are configured to prepare the individual joints and then assembly the joints together.

For example, the drill pipe stand may be constructed as follows. A first joint of drill pipe 800 is lifted by pipe lift arms from the pipe racks level to the drill pipe stand building unit level (e.g., elevated). The joint of drill pipe is rolled into a first station and stopped by pins. In the first station, the thread protectors are removed from the joint of drill pipe by thread protector fixtures that engage either end of the joint of drill pipe. For example, the thread protector fixtures may engage the threads of the ends simultaneously, spinning the thread protectors out of the drill pipe and then releasing from the joint of drill pipe. The joint of drill pipe is moved to the second station to dope, strap and position the joint of drill pipe to assemble a stand. The first joint of drill pipe is moved axially to position the pin end of the casing at an end stop.

A second joint of drill pipe is the loaded into the drill pipe skid 206 and prepared as with the first joint. The second joint of drill pipe is moved axially to position the pin end of the drill pipe to engage with the box end of the first joint of drill pipe. A third joint of drill pipe is then loaded into the skid and prepared as with the first and second joints. The third joint of drill pipe is moved to the second station to dope and position the joint of drill pipe to assemble a stand. The third joint of drill pipe is moved axially to position the pin end of the drill pipe to engage with the box end of the second joint of drill pipe.

Rubberized wheels (or other moving devices) raise and engage with the first, second and third joints of drill pipe contained in the drill pipe stand assembly trough and spin to shoulder the connections. Upon completion of the stand assembly, the rubberized wheels lower from the assembly trough and the stand of drill pipe is kicked from the stand assembly trough and rolled onto the power catwalk 120.

Figure 10:
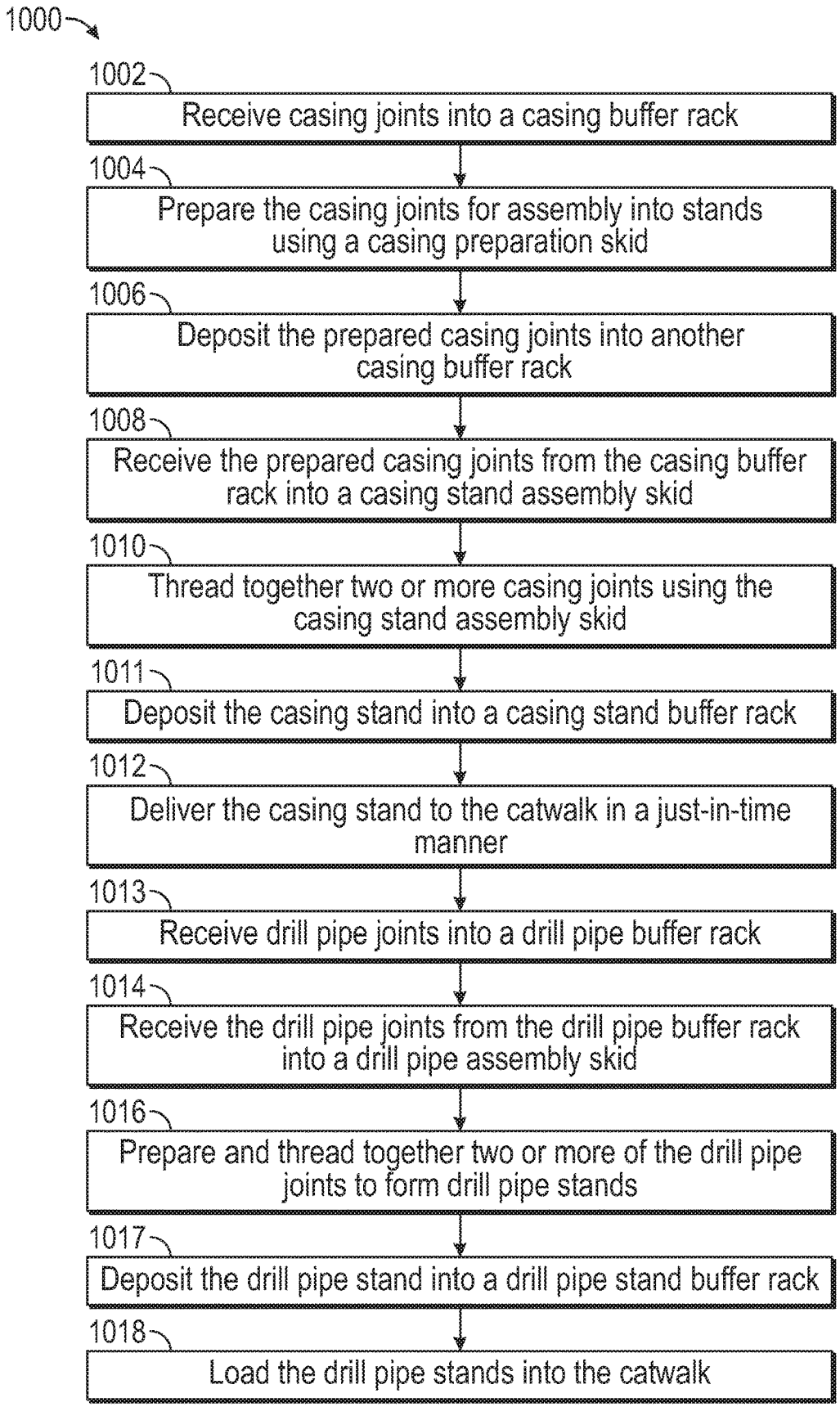
FIG. 10 illustrates a flowchart of a method for horizontal, off-rig assembly of casing and drill pipes for an oilfield rig, according to an embodiment.

FIG. 10 illustrates a flowchart of a method 1000 for horizontal, off-rig assembly of casing and drill pipes for an oilfield drilling rig, according to an embodiment. The method 1000 may be executed using one or more embodiments of the horizontal pipe preparation assembly 200 discussed above, and thus is described herein with reference thereby by way of example, and not by way of limitation to any particular structure unless otherwise indicated.

The method 1000 may include receiving casing joints into a casing buffer rack 207, as at 1002. The casing joints may be positioned in the casing buffer rack 207, generally in a horizontal orientation, and may be stockpiled and held in the rack 207 until needed for a just-in-time delivery to the rig 100, or until otherwise determined to be prepared.

The casing joints may then be received into a casing preparation skid 202, which prepares the casing joints for assembly into stands, as at 1004. As described above, this may include removing thread protectors from the casing joints, cleaning the threads, strapping and drifting the casing joints, and doping and marking the casing joints. Each of these preparation activities may occur in sequence for a given casing joint, and may, for example, proceed in parallel for multiple joints, e.g., one each for each of the operations at a time.

The prepared casing joints may then be deposited into another casing buffer rack 208, as at 1006. The prepared casing joints may be held in the casing buffer rack 208 until needed for a just-in-time delivery of casing stands to the rig 100, or until otherwise called for to be used.

The prepared casing joints may then be received from the casing buffer rack 208 into a casing stand assembly skid 204, as at 1008. In the casing stand assembly skid 204, two or more casing joints may be threaded together, end-to-end, thereby forming a stand of casing, as at 1010. The stand of casing may then be deposited into a casing stand buffer rack 210, as at 1011. The casing stands in the casing buffer rack 210 may be held in the casing buffer rack 208 until needed for a just-in-time delivery to the rig 100, or until otherwise called for to be used. Accordingly, the method 1000 may include delivering the casing stand to the catwalk 120 for just-in-time supply to the rig floor 102, as at 1012.

Building the casing stands in a just-in-time fashion may be conducted by monitoring the number of casing joints and casing stands in the associated buffer racks and preparing joints and connecting the prepared joints together to form stands in response to the buffer racks containing a lower threshold (e.g., a predetermined lower number) of joints or stands, and may be conducted until the buffer racks contain an upper threshold (e.g., predetermined higher number) of joints or stands. In other embodiments, the length of time taken to prepare the casing joints or drill pipe joints, connect together stands, and run the stands into the well may be manipulated to occur at the same rate, which may allow for omitting one, some, or all of the buffer racks 207, 208, 210.

In some embodiments, receiving the casing joints into the casing preparing skid 202 at 1002, and then preparing the casing joints at 1004, may be conducted in response to the casing buffer rack 208 having zero, or another predetermined low number of prepared casing joints, therein. Similarly, receiving and connecting together the prepared casing joints in the casing stand assembly skid 204 at 1008 and 1010, may be conducted in response to the casing stand buffer rack 210 containing zero or another predetermined low number of casing stands therein. Once a predetermined upper threshold of joints/stands in the appropriate buffer racks is reached (e.g., the buffer rack is full), the building process immediately upstream of the respective buffer rack may be halted. As such, the appropriate buffers may be maintained with a sufficient number of joints/stands so as to continuously deliver casing stands to the drilling rig 100, despite, e.g., the preparation and connecting together operations taking a different amount of time than each other, and a different amount of time than running the casings into the wellbore. In another embodiment, the determination of when to prepare the casing joints and/or build the stands may occur based on the rate at which such casing is run into the well by the drilling rig 100 (e.g., the "run rate" of the casing). Thus, the casing joints may be prepared and/or assembled together in response to (i.e., to maintain, without providing too many) the run-rate of the casing stands into the well.

Before, during, or after preparation and assembly of the casing stands, the method 1000 may also include preparing drill pipe stands. In particular, according to an example, the method 1000 may include receiving drill pipe joints into a drill pipe buffer rack 212, as at 1013. From the drill pipe buffer rack 212, e.g., when needed for just-in-time delivery to the rig 100, the drill pipe may be received into a drill pipe stand skid 206, as at 1014. In the drill pipe stand skid 206, two or more drill pipes may be prepared and threaded together, end-to-end, to form drill pipe stands, as at 1016. Thereafter, the drill pipe stands may be loaded into the drill pipe stand buffer rack 804, as at 1017, and then to the catwalk 120 as needed to support drilling operations, as at 1018.

Similar to the casing-stand building process, the drill pipe stand building process may also be a just-in-time system, which may be enforced by monitoring and regulating the number of drill pipe stands in the drill pipe stand buffer rack 804. As with the casing stand building process, in some embodiments, the drill pipe stand building process may be manipulated to occur at the same rate at which the drill pipe is run into the well, thereby allowing the buffer rack 804 to be omitted. In another embodiment, new drill pipes may be received into the skid 206 at 1014 in response to the drill pipe stand buffer rack 804 having reached or dropped below a predetermined low number of drill pipe stands contained therein. The drill pipe stand building process may then repeat, loading new drill pipe stands into the drill pipe stand buffer rack 804, preparing them and connecting them together at 1016, until the drill pipe stand buffer rack 804 reaches a predetermined high number of drill pipe stands, which may be greater than the predetermined low number. In another embodiment, the determination of when to prepare the drill pipe and/or prepare the drill pipe stands may be made based on the rate at which the drill pipe is run into the well by the drilling rig 100 (e.g., the "run rate" of the drill pipe).

Accordingly, it will be seen that the presently disclosed apparatus and method provides for a compact, automated system of providing oilfield tubulars to a drilling rig. The horizontal pipe preparation assembly 200 may further include buffers, as mentioned above, before, between, and/or after separate preparation and assembly skids. The provision of such buffers allows for a minimum of stands to be prepared before drilling and/or completion commences. Further, the buffers allow for operations to take different amounts of time, without resulting in bottlenecks that hold up drilling operation. Moreover, the parallel arrangement of the skids and buffers results in an efficient use of the area around the rig, which, in some instances, may be at a premium. Thus, the present rig and method reduce the critical path rig time by running casing in doubles and increase drill floor safety by moving the casing stand building away from the drilling activities at well center.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A stand-building system for a drilling rig, comprising:

a casing preparation skid configured to prepare a casing joint for connection to another casing joint via one or more stations configured to at least one of: remove a thread protector from the casing joint, clean threads of the casing joint, strap the casing joint, drift the casing joint, dope the casing joint, or mark the casing joint;

a first casing buffer rack configured to receive the prepared casing joint from the casing preparation skid; and a casing stand assembly skid configured to receive the prepared casing joint from the first casing buffer rack and to connect together the prepared casing joint with one or more other joints so as to form a casing stand, wherein the casing preparation skid, the first casing buffer rack, and the casing stand assembly skid are horizontally aligned with and extend parallel to one another and to a catwalk of the drilling rig, wherein the casing preparation skid, the first casing buffer rack, and the casing stand assembly skid are arranged in order in a first sequence leading to the catwalk, and wherein the casing stand assembly skid is configured to deliver the casing stand to the catwalk.

2. The system of claim 1, wherein the one or more stations of the casing preparation skid comprise a thread protector removal station.

3. The system of claim 1, further comprising a second casing buffer rack configured to receive the casing stand from the casing stand assembly skid, wherein the second casing buffer rack is configured to provide the casing stand from the casing stand assembly skid to the catwalk, wherein the casing preparation skid, the first casing buffer rack, the casing stand assembly skid, and the second casing buffer rack are arranged in order in the first sequence leading to the catwalk.

4. The system of claim 3, wherein the second casing buffer rack is configured to provide the casing stand to the catwalk for just-in-time delivery to a rig floor of the drilling rig.

5. The system of claim 3, further comprising a third casing buffer rack coupled to the casing preparation skid and configured to provide the casing joint thereto, wherein the third casing buffer rack, the casing preparation skid, the first casing buffer rack, the casing stand assembly skid, and the second casing buffer rack are arranged in order in the first sequence leading to the catwalk.

6. The system of claim 1, wherein the one or more stations of the casing preparation skid are configured to at least three of: remove the thread protector from the casing joint, clean the threads of the casing joint, strap the casing joint, drift the casing joint, dope the casing joint, or mark the casing joint.

7. The system of claim 1, wherein the casing stand assembly skid comprises a bucking unit configured to rotate two casing joints so as to connect the casing joints together.

8. The system of claim 1, further comprising a drill pipe preparation skid configured to prepare stands of drill pipe and provide the stands of drill pipe to the catwalk, wherein the drill pipe preparation skid is horizontally aligned with and oriented parallel to the catwalk.

9. The system of claim 8, further comprising a drill pipe buffer rack configured to provide a drill pipe to the drill pipe preparation skid, wherein the drill pipe buffer rack and the drill pipe preparation skid arranged in order in a second sequence leading to the catwalk, wherein the first and second sequences are disposed on opposite sides of the catwalk.

10. The system of claim 9, further comprising:

a second casing buffer rack configured to receive the casing stand from the casing stand assembly skid, wherein the second casing buffer rack is configured to provide the casing stand from the casing stand assembly skid to the catwalk, wherein the casing preparation skid, the first casing buffer rack, the casing stand assembly skid, and the second casing buffer rack are arranged in order in the first sequence leading to the catwalk, wherein the casing preparation skid, the first casing buffer rack, the casing stand assembly skid, the second casing buffer rack, the drill pipe preparation skid, and the drill pipe buffer rack are all horizontally aligned with and oriented parallel to one another and the catwalk.

11. The system of claim 10, comprising a third casing buffer rack coupled to the casing preparation skid and configured to provide the casing joint thereto, wherein the third casing buffer rack, the casing preparation skid, the first casing buffer rack, the casing stand assembly skid, and the second casing buffer rack are arranged in order in the first sequence leading to the catwalk, wherein the catwalk is positioned between the drill pipe preparation skid and the casing stand assembly skid.

12. A method of stand-building and just-in-time delivery thereof to a drilling rig, comprising:

receiving a casing joint in a casing preparation skid;

preparing the casing joint for assembly into a casing stand using the casing preparation skid, wherein preparing the casing joint comprises at least one of: removing a thread protector from the casing joint, cleaning threads of the casing joint, strapping the casing joint, drifting the casing joint, doping the casing joint, or marking the casing joint;

depositing the prepared casing joint into a first casing buffer rack after the casing preparation skid;

receiving the prepared casing joint into a casing stand assembly skid after the first casing buffer rack;

connecting the prepared casing joint with at least one other casing joint so as to form a casing stand, using the casing stand assembly skid; and receiving the casing stand into a catwalk that is configured to deliver the casing stand to tubular handling equipment of a drilling rig, wherein the casing preparation skid, the first casing buffer rack, and the casing stand assembly skid are horizontally aligned with and extend parallel to one another and the catwalk, wherein the casing preparation skid, the first casing buffer rack, and the casing stand assembly skid are arranged in order in a first sequence leading to the catwalk.

13. The method of claim 12, further comprising:

depositing the casing stand into a second casing buffer rack after connecting the casing joint with the at least one other casing joint so as to form the casing stand, wherein the catwalk receives the casing stand from the second casing buffer rack; and receiving the casing joint into a third casing buffer rack, wherein the casing joint is received into the casing preparation skid from the third casing buffer rack;

wherein the third casing buffer rack, the casing preparation skid, the first casing buffer rack, the casing stand assembly skid, and the second casing buffer rack are arranged in order in the first sequence leading to the catwalk.

14. The method of claim 13, wherein preparing the casing joint takes a different length of time than connecting the prepared casing joint to the at least one other casing joint to form the casing stand, wherein preparing the casing joint takes a different length of time than running the casing stand into a well, and wherein the first and second casing buffer racks are configured to store casing joints and casing stands, respectively, to account for the different lengths of time.

15. The method of claim 13, wherein receiving the casing joint from the third casing buffer rack into the casing preparation skid is in response to at least one of:

the first casing buffer rack having a predetermined low number of casing joints contained therein; or a run rate of casing into a well.

16. The method of claim 13, wherein receiving the at least one casing joint from the first casing buffer rack into the casing stand assembly skid is conducted in response to at least one of:

the second casing buffer rack having a predetermined low number of casing stands contained therein; or a run rate of casing into a well.

17. The method of claim 12, further comprising building a drill pipe stand, comprising:

receiving drill pipe joints into a drill pipe buffer rack;

receiving at least two of the drill pipe joints from the drill pipe buffer rack into a drill pipe stand building skid;

building a drill pipe stand via the drill pipe stand building skid at least by connecting together the at least two of the drill pipe joints to form the drill pipe stand;

depositing the drill pipe stand into a drill pipe stand buffer rack;

receiving the drill pipe stand from the drill pipe stand buffer rack in a catwalk, wherein the drill pipe buffer rack, the drill pipe stand building skid, and the drill pipe stand buffer rack are arranged in order in a second sequence leading to the catwalk, wherein the first and second sequences are disposed on opposite sides of the catwalk; and delivering the drill pipe stand to a rig floor using the catwalk.

18. The method of claim 17, wherein building the drill pipe stand is initiated in response to a number of drill pipe stands in the drill pipe stand buffer rack being a predetermined low number of drill pipe stands, and wherein building the drill pipe stand is repeated until the drill pipe stand buffer rack contains a predetermined high number of drill pipe stands.

19. The method of claim 17, wherein building the drill pipe stand is initiated or controlled in response to a run rate of drill pipes into a well.

20. A method of stand-building and just-in-time delivery thereof to a drilling rig, comprising:

receiving a casing joint into a first casing buffer rack;

receiving the casing joint from the first casing buffer rack into a casing preparation skid;

preparing the casing joint for assembly into a casing stand using the casing preparation skid, wherein preparing the casing joint comprises at least one of: removing a thread protector from the casing joint, cleaning threads of the casing joint, strapping the casing joint, drifting the casing joint, doping the casing joint, or marking the casing joint;

depositing the prepared casing joint into a second casing buffer rack;

receiving the prepared casing joint from the second casing buffer rack into a casing stand assembly skid;

connecting the prepared casing joint with at least one other casing joint so as to form a casing stand, using the casing stand assembly skid;

depositing the casing stand into a casing stand buffer rack;

receiving the casing stand from the casing stand buffer rack into a catwalk of the drilling rig that is configured to deliver the casing stand to tubular handling equipment of the drilling rig, wherein the casing preparation skid and the casing stand assembly skid are horizontally aligned with and extend parallel to one another and the catwalk, wherein the first casing buffer rack the casing preparation skid, the second casing buffer rack, the casing stand assembly skid, and the casing stand buffer rack are arranged in order in a first sequence leading to the catwalk, wherein receiving the casing joint from the first casing buffer rack into the casing preparation skid is only performed in response to at least one of:

the second casing buffer rack having a predetermined low number of casing joints contained therein; or a run rate of casing into a well, and wherein receiving the at least one casing joint from the second casing buffer rack into the casing stand assembly skid is only performed in response to at least one of:

the casing stand buffer rack having a predetermined low number of casing stands contained therein; or the run rate of casing into the well.

* * * * *